US006126386A

United States Patent [19]

Kohyama et al.

[11] Patent Number: 6,126,386

[45] Date of Patent: Oct. 3, 2000

[54] PUMP AND MEDIUM CIRCULATION APPARATUS

[75] Inventors: Katsuhiko Kohyama; Toshihiro Kameda; Tetsuhiro Okada; Hideharu Yamazaki, all of Saitama, Japan

[73] Assignee: Honda Giken Kogyo Kabushiki Kaisha, Tokyo, Japan

[21] Appl. No.: 08/923,235

[22] Filed: Sep. 4, 1997

[30] Foreign Application Priority Data

Sep. 6, 1996 [JP] Japan ..... 8-236498

[51] Int. Cl.[7] ..... A63B 31/00

[52] U.S. Cl. ..... 415/55.1; 415/200; 415/217.1; 416/176; 416/241 A; 62/476

[58] Field of Search ..... 415/55.1, 200, 415/217.1; 416/176, 241 A; 62/476

[56] References Cited

U.S. PATENT DOCUMENTS

| | | | |
|---|---|---|---|
| 2,782,722 | 2/1957 | Chubbuck et al. . | |
| 3,354,529 | 11/1967 | James . | |
| 3,846,045 | 11/1974 | Mincuzzi . | |
| 4,455,247 | 6/1984 | Nakayama et al. | 252/67 |
| 5,221,184 | 6/1993 | Gesenhues et al. | 415/216.1 |
| 5,407,318 | 4/1995 | Ito et al. | 415/55.1 |
| 5,521,260 | 5/1996 | Futaesaku et al. | 525/502 |
| 5,549,446 | 8/1996 | Gaston et al. | 415/55.1 |
| 5,716,191 | 2/1998 | Ito et al. | 415/55.4 |
| 5,765,992 | 5/1998 | Muramatsu et al. | 415/55.1 |
| 5,802,869 | 9/1998 | Kagawa et al. | 62/476 |

FOREIGN PATENT DOCUMENTS

| | | | |
|---|---|---|---|
| 1248048 | of 1960 | France . | |
| 266481 | 4/1989 | Germany | 415/55.1 |
| 63-12504 | of 1988 | Japan . | |
| 3-115794 | of 1991 | Japan . | |
| 929790 | of 1963 | United Kingdom . | |

OTHER PUBLICATIONS

Roy Carter et al., "Regenerative Pumps", Pump Questions and Answers, Mc–Graw Hill Book Company, Inc., New York, pp. 187–195, Dec. 1949.

"Plastic in Pumps" by J.M. Grindley, Pumps–Pompes–Pumpen, vol. 130, 1977, XP 002050745.

"Comments on the Constructional Details fo Plastic Pumps" by L. Sterling, Pumps–Pompes–Pumpen, vol. 106, XP002050746, p. 798–p. 803.

Patent Abstract of JP 03115794 "Rotor For Pump".

European Search Report.

*Primary Examiner*—Edward K. Look
*Assistant Examiner*—Matthew T. Shanley
*Attorney, Agent, or Firm*—Lyon & Lyon LLP

[57] ABSTRACT

A pump has a rotor made of synthetic resin in a fixed housing which are adjacently arranged while forming a gap between the housing and the rotor to force-feed a medium containing water moisture, in which the rotor is made of a resol-type synthetic resin so that a dimensional change rate of the rotor is 0.15% or less for a medium having a moisture content rate of 10 wt % or less, whereby a sufficient pump performance can be obtained while relatively increasing the degree of freedom of the moisture content rate of the medium to reduce the corrosiveness of the medium.

19 Claims, 5 Drawing Sheets

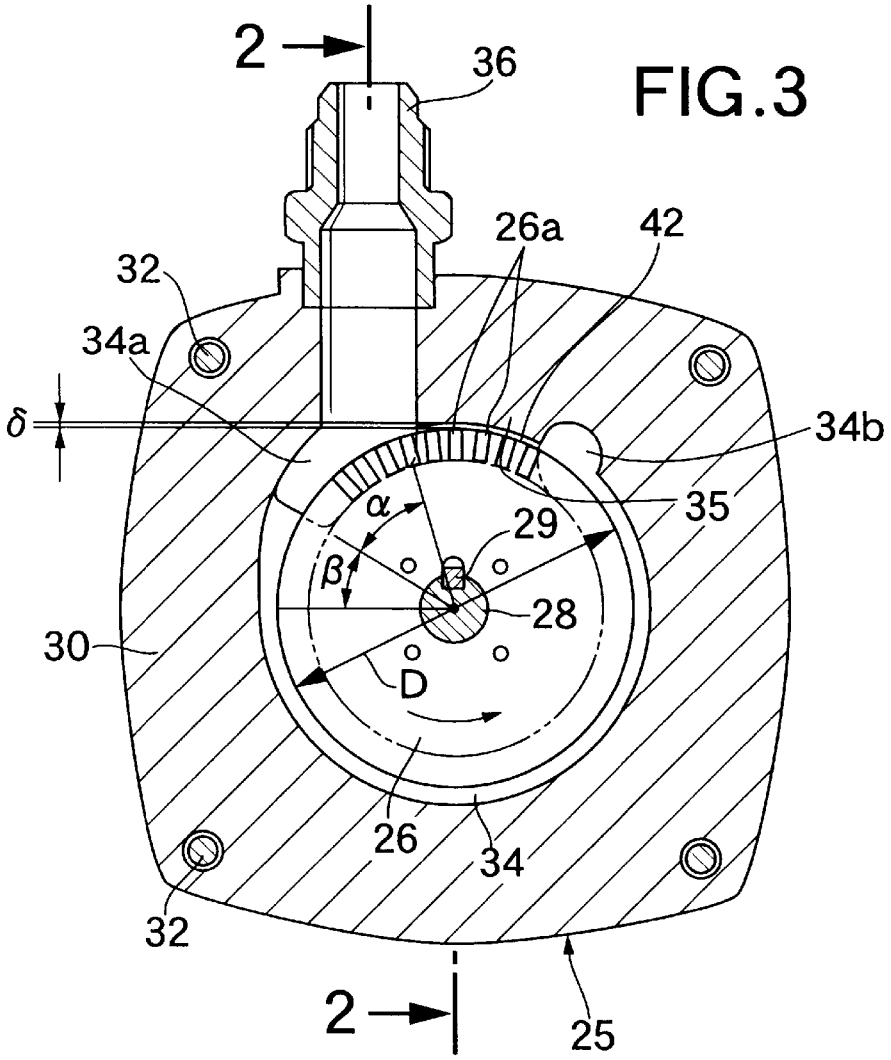
FIG.3
FIG.4
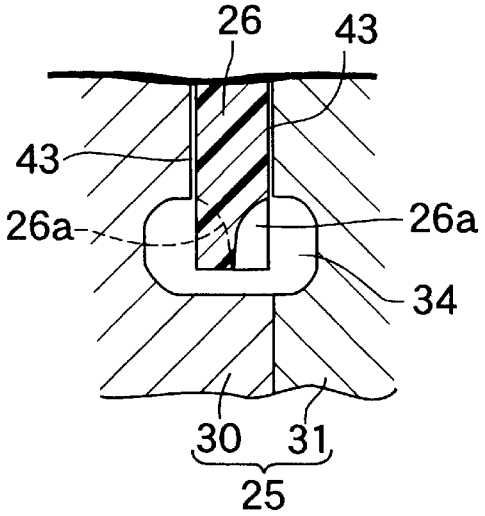

PUMP AND MEDIUM CIRCULATION APPARATUS

BACKGROUND OF THE INVENTION

1. Field of the Invention

The present invention relates to a pump comprising a rotor made of synthetic resin and a housing for the rotor arranged adjacent to the rotor with a gap formed between the housing and the rotor to raise the pressure of a medium obtained by adding water to a solution, and further to a medium circulation apparatus using the pump.

2. Description of the Related Art

In the case of the above pump, the rotor is made of synthetic resin to decrease its weight, for example. However, if moisture is contained in a medium, the rotor made of synthetic resin is swelled by the moisture contained in the medium, the gap dimension between the housing and the rotor changes whereby the desired pump performance may not be obtained. Therefore, it is if necessary to control the swelling of the rotor. Thus, Japanese Patent application Laid-Open No. 3-115794 discloses a material for suppressing the swelling of a rotor made of synthetic resin. In order to suppress the swelling due to the moisture contained in fuel, the rotor is made of a material obtained by blending phenol aralkyl resin and a filler with phenol resin.

However, the above conventional rotor is used for a pump for force-feeding a fuel having a moisture content rate of up to approx. 0.5 wt %. In the case of a medium containing a solution that causes corroding of a light metal, Japanese Patent Publication No. 63-12504 discloses that corrosion resistance can be provided for the light metal by adding water to the solution until the moisture content rate of the medium is up to about 15 wt %. However, when applying the pump disclosed in Japanese Patent application Laid-Open No. 3-115794 to the medium having a large moisture content rate as mentioned above, there is insufficient swelling resistance and the desired pump performance cannot be obtained.

Therefore, it is desired that a sufficient pump performance be obtained even when force-feeding a medium having a relatively large moisture content rate by a pump using a rotor made of synthetic resin. In the case of this pump, however, the gap dimension between the rotor and the housing greatly influences the pump performance. Therefore, in order to obtain a sufficient pump performance, it is necessary to secure a minimum gap dimension. Then, based on the minimum gap dimension, it is possible to set the upper limit value of the dimensional change rate of a rotor due to the swelling. On the other hand, in order to improve the corrosion resistance of a light metal, it is indispensable to set the degree of freedom of the moisture content rate of the medium, that is, the increased range of water quantity to be added, at a relatively large value and it is necessary to select synthetic resin for forming a rotor so that the degree of freedom of the moisture content rate in the medium can be relatively large with respect to the upper-limit dimensional change rate of the rotor due to the above-described swelling.

SUMMARY OF THE INVENTION

The present invention is made to solve the above problem and to provide a pump capable of obtaining a sufficient pump performance while relatively increasing the degree of freedom of the moisture content rate of a medium and a medium circulation apparatus using the pump.

To achieve the above object, according to a first aspect of the present invention, in a pump comprising a fixed housing and a rotor made of synthetic resin and rotating in the housing which are adjacently arranged while forming a gap between the housing and the rotor to raise the pressure of a medium obtained by adding water to a solution, the rotor is formed with the synthetic resin so that the dimensional change rate of the rotor decreases to 0.15% or less relative to a medium having a moisture content rate of 10 wt % or less.

The upper limit of the dimensional change rate of a rotor due to swelling by moisture can be set by considering a previously-expectable dimensional tolerance and thermal expansion in accordance with a minimum dimension necessary for the gap between a rotor and a housing in order to obtain a sufficient pump performance. When using synthetic resin for decreasing the dimensional change rate of the rotor to 0.15% or less, the upper limit value of the moisture content rate in a medium can be set at 10 wt %. Therefore, it is possible to sufficiently raise the moisture content rate in the medium while keeping a sufficient pump performance.

Moreover, according to a second aspect of the present invention, the weight of a pump can be decreased while improving the corrosion resistance of a light metal by sufficiently increasing the moisture content rate in a medium because at least a portion of the pump except the rotor which contacts the medium is made of the light metal subject to being corroded by the solution.

According to a third aspect of the present invention, a rotor is made of resol-type phenol resin. Moreover, according to a fourth aspect of the present invention, resol-type phenol resin is resol-type high-heat phenol resin equivalent to PM-HH-R in JIS-K-6915 or resol-type heat-resistant and impact phenol resin equivalent to PM-HM-R in JIS-K-6915.

Resol-type phenol resin is ammonia-free phenol resin based on glass fiber, which has a small dimensional change and a small strength change in a solution and which is superior in solution-resistant stability. Therefore, it is possible to decrease the weight of a rotor, that is, a pump and moreover obtain a superior durability. Furthermore, resol-type phenol resin makes it possible to maintain the degree of swelling due to moisture at a very low level. Therefore, for a medium having a high moisture content rate in order to improve the corrosion resistance of a light metal, it is possible to greatly decrease the dimensional change rate of a rotor which greatly changes the gap dimension between a housing and the rotor due to swelling and thus, it is possible to obtain a desired pump performance.

According to a fifth aspect of the present invention, the above pump is provided in a closed circuit for circulating a medium obtained by adding water to a solution having a function of corroding a light metal and at least a part of the portion constituting a part of the closed circuit and contacting the medium is made of a light metal. According to a sixth aspect of the present invention, a medium circulation apparatus comprises a low-pressure closed circuit. According to a seventh aspect of the present invention, a medium circulation apparatus comprises an absorption-type cooling unit or a pair of fluid-absorption-type circulation apparatuses.

Even if at least a part of the closed circuit is made of a light metal, the corrosion resistance of the light metal is improved by using a pump capable of force-feeding a medium having a high moisture content rate with a sufficient pump performance.

According to an eighth aspect of the present invention, a solution serving as a part of a medium used for an absorption-type cooling unit is made of fluorine-containing alcohol and heterocyclic organic compound.

By using fluorine-containing alcohol serving as a refrigerant and heterocyclic organic compound serving as an absorbent, it is possible to obtain the performances required for a circulation medium of an absorption-type cooling unit such as low combustibility, high heat efficiency, noncrystallinity, superior heat stability, and high cooling capacity. Although fluorine-contained alcohol and heterocyclic organic compound have a strong corrosiveness to light metals, it is possible to weaken the corrosiveness by adding water to a solution.

According to a ninth aspect of the present invention, the pump is a Wesco-type pump. This Wesco-type pump hardly causes cavitation and therefore, it is possible to minimize the occurrence of the cavitation in an absorption-type cooling unit serving as a low-pressure circuit. Even if the cavitation occurs, it is possible to provide impact resistance for a rotor by absorbing impact when bubbles collapse due to the cavitation by means of the elasticity of synthetic resin because the rotor is made of the synthetic resin.

The above and other objects, features, and advantages of the present invention will become more apparent from the preferred embodiment described below in detail when taken in conjunction with the accompanying drawings.

BRIEF DESCRIPTION OF THE DRAWINGS

FIGS. 1 to 6 show an embodiment of the present invention in which:

FIG. 1 is a system diagram showing a structure of a stationary-type household air conditioner;

FIG. 2 is a sectional view of the Wesco-type pump, taken along a line 2—2 in FIG. 3;

FIG. 3 is a sectional view of the pump, taken along a line 3—3 in FIG. 2;

FIG. 4 is an enlarged view of a portion within the ellipse 4 in FIG. 2;

FIG. 5 is a graph showing a relation of pump efficiency and moisture content rate to dimensional change rate; and FIG. 6 is a graph showing a relation of dimensional change rate due to swelling to moisture content rate.

DETAILED DESCRIPTION OF THE PREFERRED EMBODIMENT

Figure 1:
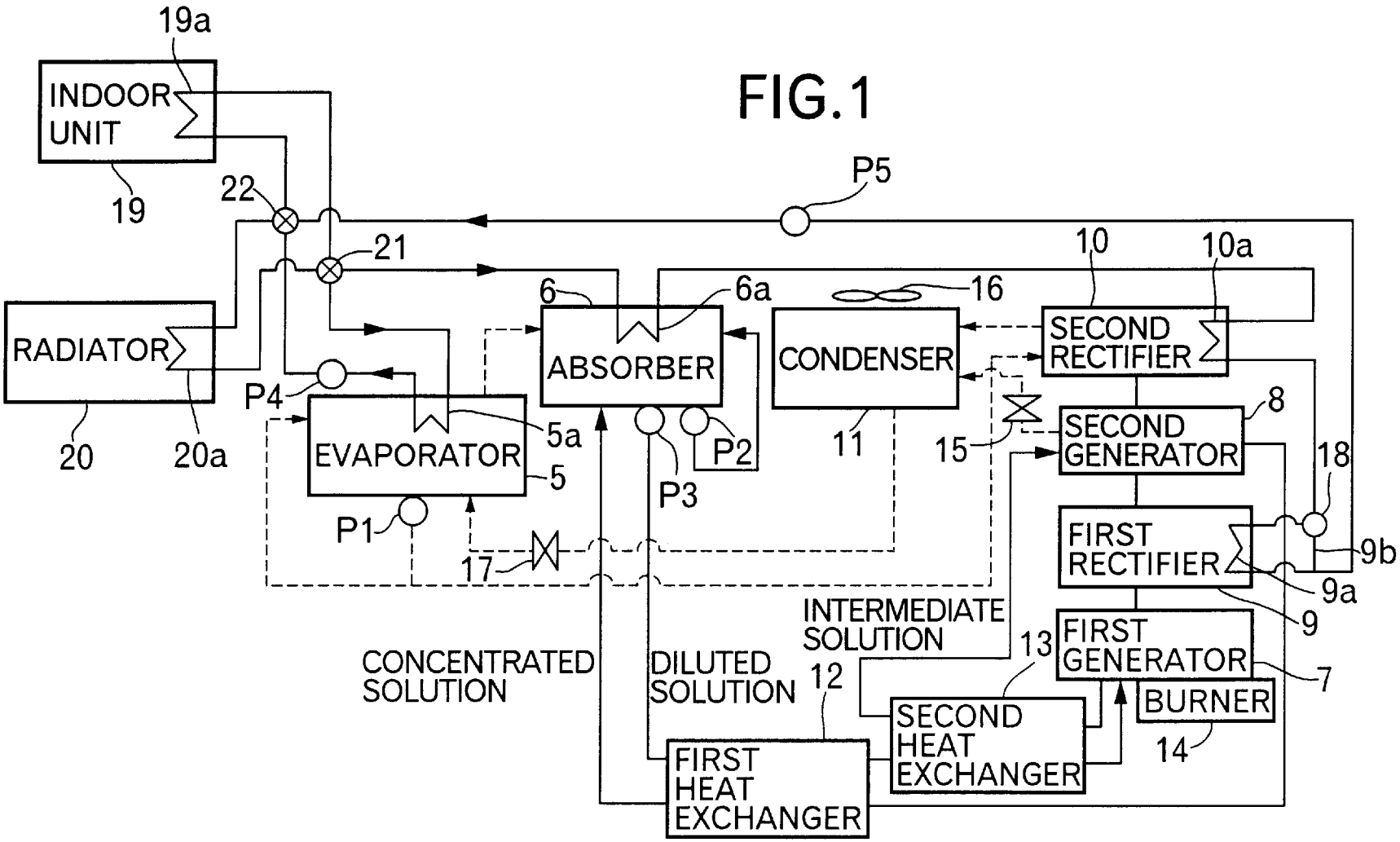

First, in FIG. 1, the absorption-type cooling unit provided for the stationary-type household air conditioner comprising an evaporator 5, an absorber 6, two-stage first and second generators 7 and 8, a first rectifier or partial condenser 9, a second rectifier or partial condenser 10, a condenser 11, and first and second heat exchangers 12 and 13 is constituted into a low-pressure closed circuit system.

The evaporator 5 stores a refrigerant and the absorber 6 stores an absorbing solution containing an absorbent. The evaporator 5 and the absorber 6 are connected to each other and kept under a low-pressure condition at an absolute pressure of approximately 30 mmHg, in which the refrigerant is evaporated by the evaporator 5 and the refrigerant is absorbed by the absorbing solution in the absorber 6.

A conduit 5*a* for circulating brine is set in the evaporator 5 and the refrigerant changes to a low-pressure refrigerant vapor by obtaining the heat of evaporation from the brine. Moreover, the refrigerant in the evaporator 5 is discharged from the evaporator 5 by a pump P1, with only a small part of the discharged refrigerant being supplied to the second rectifier 10, and the remaining major part of the refrigerant being sprayed onto the conduit 5*a* by a not-illustrated spraying means in the evaporator 5.

In the absorber 6, heat of absorption is produced because refrigerant vapor is absorbed by the absorbing solution. However, the absorbing solution is cooled due to heat exchange with the brine circulating through the conduit 6*a* provided in the absorber 6, thereby accelerating absorption of the refrigerant vapor in the absorber 6 and refrigerant evaporation in the evaporator 5. Moreover, the absorbing solution in the absorber 6 is discharged from the absorber 6 by the pump P2 and sprayed on the conduit 6*a* by a not-illustrated spraying means in the absorber 6.

The absorbent concentration of the absorbing solution in the absorber 6 is lowered by absorbing the refrigerant vapor and the absorbing capacity is deteriorated. Therefore, in order to restore the absorbing capacity of the absorbing solution by separating the refrigerant vapor from the absorbing solution, a diluted solution discharged from the absorber 6 by a pump P3 is sent to the first generator 7.

The first generator 7 constitutes a double-effect generator together with the second generator 8 and the first and second rectifiers 9 and 10. The first generator 7 is provided with a burner 14. The diluted solution sent from the absorber 6 is heated by the burner 14 and boiled in the first generator 7 and refrigerant vapor produced from the boiled diluted solution is led to the first rectifier 9. The refrigerant vapor is cooled by heat exchange with the brine flowing through a conduit 9*a* provided in the first rectifier 9, and the absorbent component remaining in the refrigerant vapor is separated from the refrigerant vapor and returned to the first generator 7. Thus, an intermediate solution whose concentration is raised stays at the bottom of the first generator 7 and the intermediate solution is led to the second generator 8.

The refrigerant vapor passed through the first rectifier 9 still has a relatively high temperature and it is led to the second generator 8. In the second generator 8, the intermediate solution is heated by the refrigerant vapor supplied from the first rectifier 9 and the refrigerant vapor produced in the second generator 8 is introduced into the second rectifier 10. Thus, in the second rectifier 10, the refrigerant vapor is cooled through heat exchange with the brine flowing through a conduit 10*a* provided in the second rectifier 10, the absorbent component remaining in the refrigerant vapor is separated from the refrigerant vapor and returned to the second generator 8, a concentrated solution with a high concentration stays at the bottom of the second generator 8, and the concentrated solution is returned to the absorber 6 and used as an absorbing solution again.

The first heat exchanger 12 performs heat exchange between the concentrated solution returned to the absorber 6 from the second generator 8 and the diluted solution led from the absorber 6 by the pump P3. The concentrated solution with a relatively high temperature sent from the second generator 8 is cooled by the first heat exchanger 12 and returned to the absorber 6 and the diluted solution with a relatively low temperature sent from the absorber 6 is preliminarily heated by the first heat exchanger 12. Moreover, the second heat exchanger 13 performs heat exchange between the diluted solution led from the first heat exchanger 12 to the first generator 7 and the intermediate solution sent from the first generator 7 to the second generator 8. The diluted solution is further heated by the second heat exchanger 13 and sent to the first generator 7 and the intermediate solution is cooled by the second heat exchanger 13 and sent to the second generator 8.

The refrigerant vapor passing through the second rectifier 10 is introduced into the condenser 11 and the refrigerant vapor whose pressure is reduced by a pressure reducing valve 15 is introduced into the condenser 11 from the second generator 8. Thus, the purity of the refrigerant vapor led to the condenser 11 is increased up to, for example, approximately 99.8% and cooled by the cooling air of a fan 16 associated with the condenser 11, whereby, the refrigerant vapor is condensed in the condenser 11 as a refrigerant solution and recovered by the evaporator 5 via a pressure reducing valve 17.

Though the refrigerant recovered by the evaporator 5 has a very high purity as described above, an absorbent which is very slightly mixed with the refrigerant accumulates in the evaporator 5 over a long period of operation and therefore the purity of the refrigerant in the evaporator 5 slowly lowers. Therefore, a very small part of the refrigerant discharged from the evaporator 5 by the pump P1 is sent to the second rectifier 10 and treated together with the refrigerant vapor produced from the intermediate solution in the second rectifier 10 so as to raise the purity of the refrigerant.

A suction port of the pump P4 is connected to the conduit 5*a* of the evaporator 5. Moreover, a conduit 6*a* of the absorber 6 is connected to one end of the conduit 10*a* of the second rectifier 10 and the other end of the conduit 10*a* is connected to one end of the conduit 9*a* of the first rectifier 9 through a three-way selector valve 18 and also connected to a bypass conduit 9*b* bypassing the conduit 9*a* through the three-way selector valve 18. The three-way selector valve 18 can switch between the state of connecting the conduit 10*a* to the conduit 9*a* and the state of connecting the conduit 10*a* to the bypass conduit 9*b* and thus can control whether to circulate brine through the conduit 9*a* of the first rectifier 9. The conduit 9*a* and bypass conduit 9*b* are connected to the suction port of the pump P5.

The brine circulating through the conduit 5*a* of the evaporator 5 is cooled because the latent heat of evaporation due to evaporation of the refrigerant in the evaporator 5 is removed and the brine circulating through the conduit 6*a* of the absorber 6, conduit 10*a* of the second rectifier 10, and the conduit 9*a* of the first rectifier 9 is heated due to heat exchange with the absorbing solution and refrigerant vapor. Thus, the brine cooled and the brine heated as described above are alternatively switched by four-way selector valves 21 and 22 and supplied to a conduit 19*a* provided in an indoor unit 19 and a conduit 20*a* provided in a radiator or sensible heat exchanger 20. That is, it is possible to set the environment so that the cooled brine is supplied to the conduit 19*a* of the indoor unit 19 during cooling and the air cooled by the conduit 19*a* can be supplied into a room by a not-illustrated fan and the heated brine is supplied to the conduit 19*a* of the indoor unit 19 during heating.

In the case of the absorption-type cooling or heating unit of the above stationary-type household air conditioner, at least some of the component units such as the evaporator 5, absorber 6, first generator 7, second generator 8, first rectifier 9, second rectifier 10, condenser 11, first and second heat exchangers 12 and 13, pumps P1, P2, and P3, and pipes connecting these units 5 to 13 and P1 to P3 each other are made of a light metal in order to decrease the weight of the air conditioner.

As the above-described light metal, aluminum, magnesium, aluminum alloy, magnesium alloy, or titanium alloy is effectively used so as to decrease the air conditioner in weight and size. Moreover, as the above aluminum alloy, various alloys are used such as an Al—Cu—Mg, Al—Mg, Al—Si—Mg—Ni, Al—Mg—Cr, Al—Si—Mg, or Al—Cu—Mg—Zn alloy.

Furthermore, the medium circulating through the above absorption-type cooling unit is obtained by adding water to a solution made of fluorine-containing alcohol serving as a refrigerant and a heterocyclic organic compound serving as an absorbent.

As the fluorine-containing alcohol, it is preferable to use fluorine-containing alcohol having a boiling point between 40 to 120° C. Moreover, from the viewpoint of the cooling capacity of the absorption-type cooling unit, it is preferable to use alcohol having a perfluoroalkyl group such as a trifluoromethyl group or pentafluorethyl group and it is particularly preferable to use fluorine-containing ethanol or fluorine-containing propanol such as 2,2,2-trifluoro-1-ethanol (boiling point of 73.6° C.) or 2,2,3,3,3-pentafluoro-1-propanol (boiling point of 80.7° C.)

It is preferable that the heterocyclic organic compound serving as an absorbent is a derivative of imidazolidone, thiazole, or pyrimidine. As a imidazolidone derivative, it is preferable to use a substance having the following chemical formula.

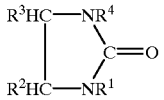

In the above chemical formula, $R^1$, $R^2$, and $R^3$ denote independently a hydrogen atom or an alkyl group having 1 to 4 carbon atoms and $R^4$ denotes an alkyl group having 1 to 4 carbon atoms.

Above all, it is preferable to use 1,3-dimethyl-2-imidazolidone, 1,3-diethyl-2-imidazolidone, 1,3-dipropyl-2-imidazolidone, or 1,3-dipropyl-4-methyl-2-imidazolidone. It is particularly preferable to use 1,3-dimethyl-2-imidazolidone or 1,3-dipropyl-2-imidazolidone because they are superior in heat exchange performance as an absorbent.

By using the above solution made of fluorine-containing alcohol and heterocyclic organic compound, it is possible to obtain the performances required for the circulation medium of the absorption-type cooling unit such as low combustibility, high heat efficiency, noncrystallinity, superior heat stability, and high cooling capacity. However, fluorine-containing alcohol and heterocyclic organic compound have a strong corrosiveness to light metals but it is possible to weaken the corrosiveness to the light metals by adding water to the solution.

As the pumps P1, P2, and P3 used for the absorption-type cooling unit which is a low-pressure closed circuit system, it is the most suitable to use a Wesco-type pump capable of minimizing cavitation easily produced due to the low pressure in a low-pressure circuit. Also, it is possible to use a gear pump or trochoid pump. Furthermore, a centrifugal pump, roller vane pump, and the like are used as the pumps P4 and P5 for feeding brine.

Figure 2:
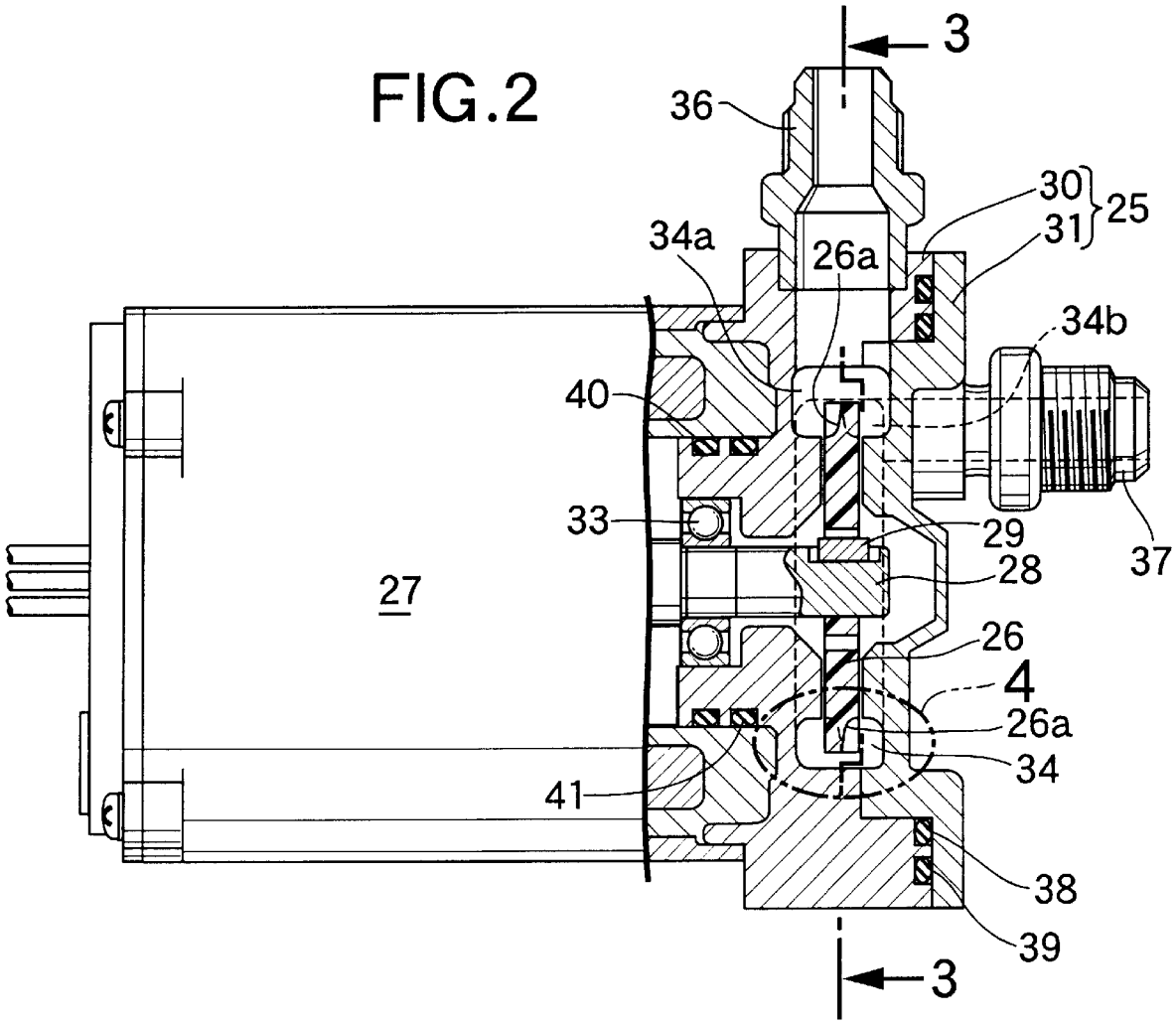

The structure of the above Wesco-type pump is described below by referring to FIGS. 2 to 4. The Wesco-type pump is provided with a light-metal housing 25 and a synthetic-resin rotor 26 rotatably housed in the housing 25, in which the rotor 26 is connected to a rotary shaft 28 of an electric motor 27 by a key 29.

The housing 25 comprises a housing body 30 and a cover 31 interconnected by a plurality of bolts 32, 32, . . . The electric motor 27 is connected to the housing body 30 at the opposite side as the cover 31 and a bearing 33 is set between the rotary shaft 28 and the housing body 30.

The discoid rotor 26 is connected to the rotary shaft 28 through the key 29 by making both the sides approach and face the housing body 30 and cover 31 and both the sides of the outer periphery of the rotor 26 are provided with a large number of vane grooves 26*a*. . . and 26*a*. . . respectively at equal intervals in the circumferential direction. Moreover, a channel 34 with which the vane grooves 26*a*. . . and 26*a*. . . on the outer periphery of the rotor 26 are faced is formed between the housing body 30 and the cover 31. The channel 34 is formed like a circular arc with which approximately 80% of the outer periphery of the rotor 26 is faced from a suction port 34*a* at one end in the circumferential direction up to a discharge port 34*b* at the other end in the circumferential direction and a partition 35 for making the remaining approximately 20% of the outer periphery of the rotor 26 approach and face is provided for the housing 25 so as to demarcate the suction port 34*a* from the discharge port 34*b*.

Moreover, most of the channel 34 is formed as a pumping channel with the same channel area. The suction port 34*a* at one end of the channel 34 in the circumferential direction is formed so as to be an enlarged channel in which the channel area is made larger than that of the pumping channel in the range of a central angle $\alpha$ (e.g. 45°) about the axis line of the rotary shaft 28 and moreover, the channel 34 in the range of a central angle $\beta$ (e.g. 30°) from the suction port 34*a* is formed so as not to suddenly change the channel area from the suction port 34*a* serving as an enlarged channel up to the pumping channel. Thus, the housing body 30 is connected to a suction-side connection pipe 36 connected to the suction port 34*a* so that the pipe 36 extends outward in a plane perpendicular to the axis line of the rotary shaft 28 and the cover 31 is connected to a discharge-side connection pipe 37 connected to the discharge port 34*b* so that the pipe 37 extends outward in parallel with the axis line of the rotary shaft 28.

Moreover, in order to keep the air tightness between the inside and outside of the pump, inside and outside double O rings 38 and 39 are provided between the housing body 30 and the cover 31 and also a pair of O rings 40 and 41 arranged in the axial direction are provided between the electric motor 27 and the housing body 30. Furthermore, among the O rings 38 to 41, the O rings 38 and 40 at the side contacting the solution in the pump are made of a material having solution resistance such as EPDM rubber or silicone rubber and the O rings 39 and 41 at the outside air side are made of a material having a high air tightness such as NBR rubber.

In the case of the above Wesco-type pump, a gap 42 is formed between the outer periphery of the rotor 26 and the partition 35 and moreover, gaps 43 and 43 are formed between both the sides of the rotor 26, the housing body 30, and the cover 31. Thus, the dimensions of these gaps 42, 43, and 43 greatly influence the pump performance. Moreover, the rotor 26 is made of synthetic resin for reduction in weight and rotates in the solution containing water. Therefore, swelling of the rotor 26 due to water poses a problem. However, the rotor 26 is thin and discoid and the diameter D of the rotor 26 is much larger than the thickness of the rotor 26. Therefore, for a dimensional change value of the rotor 26 due to swelling, the gap 42 between the outer periphery of the rotor 26 and the partition 35 has a larger dimensional change than the gaps 43 and 43 between both the sides of the rotor 26 and the housing 25. Thus, the swelling value of the rotor 26 in the radial direction poses a significant problem.

When the initial setting of the dimension $\delta$ (see FIG. 3) of the gap 42 is a very small amount, no problem occurs with the pump performance. However, the swelling of the rotor 26 in the radial direction makes the rotor 26 closely approach or contact the partition 35 of the housing 25 and thereby, rubbing or locking may occur. Moreover, when the initial setting of the dimension $\delta$ is increased, a desired pump performance cannot be obtained at the initial operating stage.

In this case, machining allowance, thermal expansion, and swelling of the rotor 26, and fitting between the rotor 26 and the rotary shaft 28 are considered as the factors related to setting of the dimension $\delta$ of the gap 42. Practically, however, it is possible to set the dimension $\delta$ by considering the machining allowance, thermal expansion, and swelling of the rotor 26 and the machining allowance, thermal expansion value, and swelling value are basically proportional to the outer periphery diameter D of the rotor 26. Therefore, as the result of performing an experiment on the change of the pump efficiency to the change rate $(2\times\delta/D)\times 100(\%)$ of the dimension $\delta$ of the gap 42 to the outer periphery diameter D of the rotor 26, a curve shown in FIG. 5 is obtained.

In this case, the outer periphery diameter D of the rotor 26 is set in a range of 30 to 120 mm as a standard value for manufacture and strength. That is, when the outer periphery diameter D exceeds 120 mm, the rotor 26 must be thick in order to improve the strength and moreover, the number of steps, such as pre-cutting, increases for manufacturing the rotor 26 and a problem occurs with the dimensional accuracy. When the outer periphery diameter D is less than 30 mm, the difficulty in machining and accuracy increases.

Figure 5:
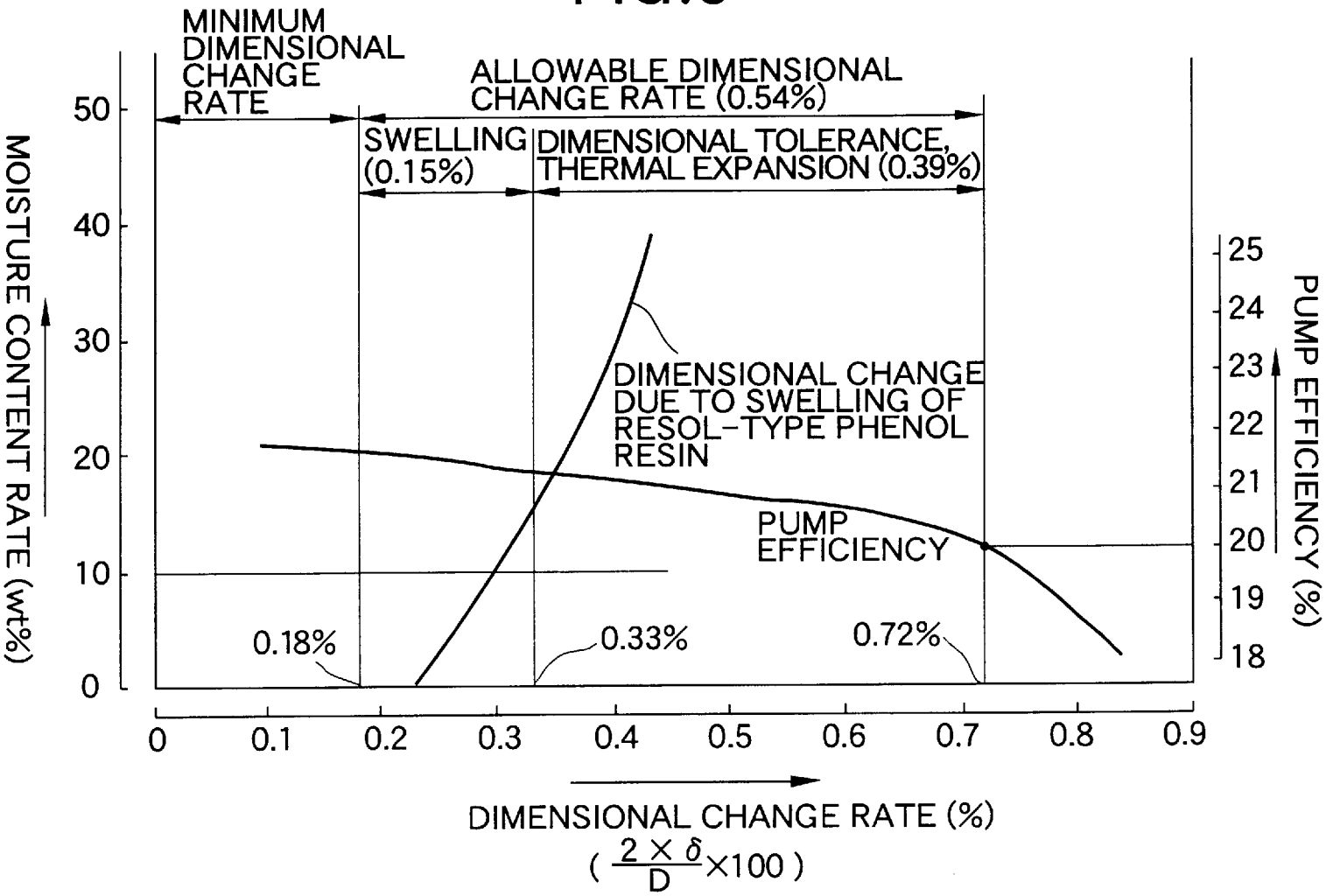

When setting the lower limit of the pump efficiency at 20% in accordance with the above setting range of the outer periphery diameter D of the rotor 26 and the operation of the rotor 26 under a low pressure (absolute pressure of 20 to 40 mmHg), the upper limit of the dimensional change rate becomes 0.72% as shown in FIG. 5. Moreover, the minimum dimensional change rate for securing the dimension $\delta$ required to prevent the rotor 26 from locking by contacting with the partition 35 of the housing 25 is 0.18% as shown in FIG. 5 and a value obtained by subtracting the minimum dimensional change rate 0.18% from the upper limit value 0.72% of the above dimensional change rate becomes an allowable dimensional change rate 0.54% due to machining allowance, thermal expansion, and swelling. In this case, the upper limit value of the dimensional change rate due to machining allowance and thermal expansion is 0.39% and therefore, the allowable change rate due to swelling becomes 0.15% at maximum.

As described above, in order to prevent the rotor 26 made of synthetic resin from locking by contacting with the partition 35 of the housing 25, it is necessary to control the maximum value of the dimensional change rate due to swelling of the rotor 26 to 0.15%. However, the rate of moisture contained in the medium is required to be a relatively large value in order to suppress the corrosive action on a light metal. Therefore, the synthetic resin for forming the rotor 26 must have a small swelling rate to moisture. As such a synthetic resin for forming the rotor 26, resol-type phenol resin is preferable.

Figure 6:
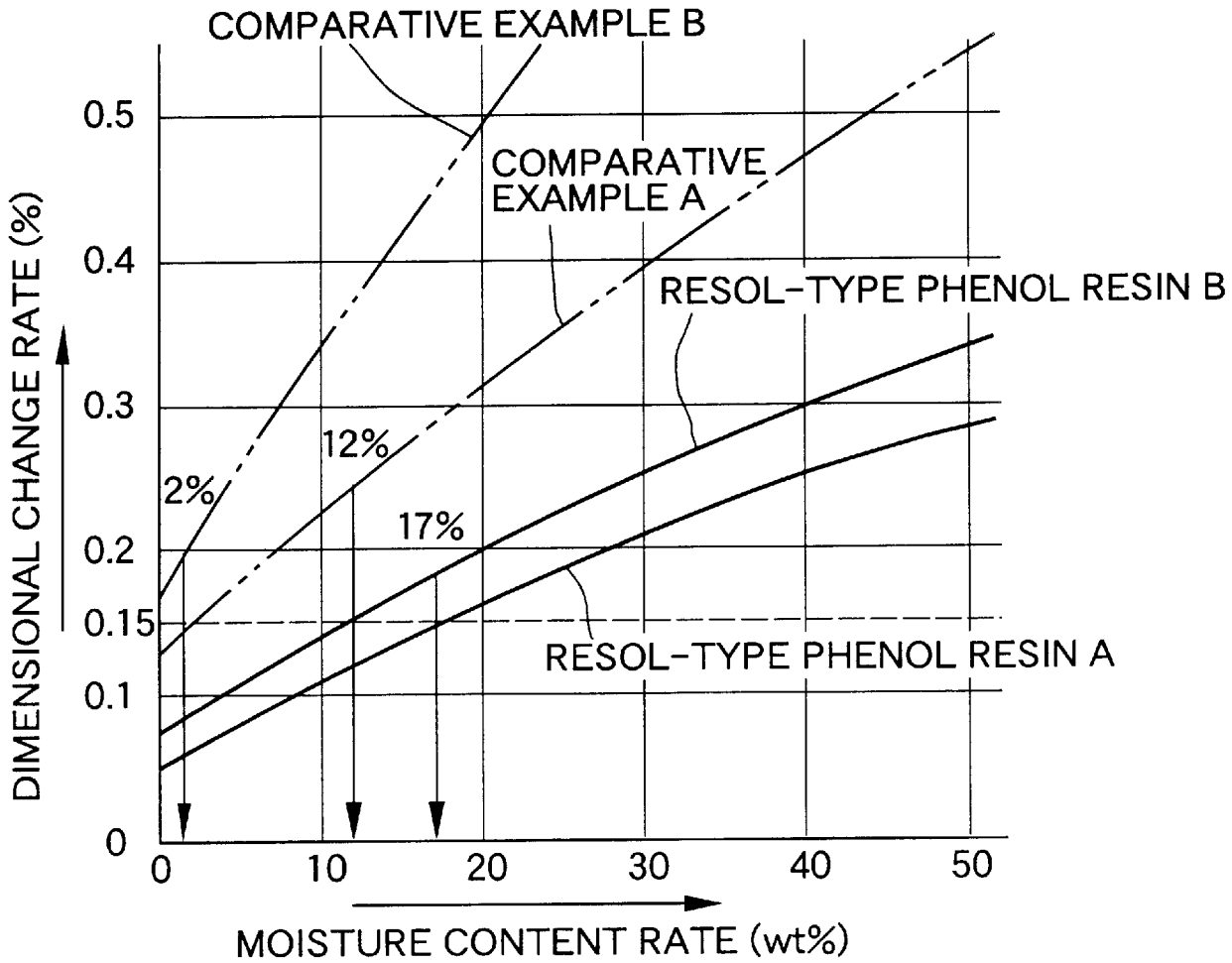

Performing an experiment on the dimensional change rate due to swelling to moisture content rate by using resol-type high-heat phenol resin with the trade name PM9625 (made by Sumitomo Bakelite Co., Ltd.; equivalent to PM-HH-R in JIS-K-6915) and resol-type heat-resistant and impact phenol resin with the trade name PM9630 (made by Sumitomo Bakelite Co., Ltd.; equivalent to PM-HM-R in JIS-K-6915), the results shown in FIG. 6 are obtained. In FIG. 6, resol-type phenol resin A is the resol-type high-heat phenol resin with the above trade name PM9625 and resol-type phenol resin B is the resol-type heat-resistant and impact phenol resin with the above trade name PM9630.

As apparent from FIG. 6, in order to control the dimensional change rate to 0.15% or less, it is possible to set a moisture content rate by increasing it up to 17 wt % for the resol-type phenol resin A and up to 12 wt % for the resol-type phenol resin B. The results show that the dimensional change rate due to swelling of the rotor 26 made of resol-type phenol resin can be controlled to 0.15% or less when setting a moisture content rate at 10 wt % or less by also considering an allowance.

It is apparent from the experiment results by the present inventors that the moisture content rate most suitable to control the corrosive action to the light metal while holding desired actions and sufficient cooling performance of a refrigerant and absorbent of the absorption-type cooling unit of the stationary-type household air conditioner is approximately 5 wt %. Moreover, as described above, it is possible to provide a degree of freedom of setting the range of the moisture content rate for further improving the corrosion resistance because the moisture content rate of the synthetic-resin rotor 26 having a dimensional change rate due to swelling of 0.15% or less can be increased up to 10 wt %.

On the other hand, by performing an experiment on the dimensional change rate due to swelling based on the moisture content rate of phenol resin mixed with phenol aralkyl resin and filler (disclosed in the Japanese Patent application Laid-Open No. 3-115794) for comparison, the curves shown as comparative examples A and B in FIG. 6 are obtained. From FIG. 6, it is clear that for the comparative example A water can be added only up to a moisture content rate of approximately 2 wt % in order to meet the allowable dimensional change rate due to swelling and a moisture content rate required to suppress the corrosion of a light metal cannot be relatively large. The comparative example B cannot meet the maximum dimensional change rate due to swelling of 0.15% with any added water, as shown in FIG. 6.

Next, functions of the embodiment will be described. By using a solution serving as a part of a medium and made of fluorine-containing alcohol serving as a refrigerant and heterocyclic organic compound serving as an absorbent for an absorption-type cooling unit which is a low-pressure closed circuit, it is possible to provide the performances such as low combustibility, high heat efficiency, noncrystallinity, superior heat stability, and high freezing capacity which are requested for the absorption-type cooling unit.

The above fluorine-containing alcohol and heterocyclic organic compound have a strong corrosiveness to a light metal. However, at least some of the components of the absorption-type cooling unit such as the evaporator 5, the absorber 6, the first generator 7, the second generator 8, the first rectifier 9, the second rectifier 10, the condenser 11, the first and second heat exchangers 12 and 13, the pumps P1, P2, and P3, and the pipes interconnecting these units 5 to 13 and P1 to P3 are made of a light metal in order to decrease the weight of the cooling unit. It is possible to weaken the corrosiveness by adding water to the solution made of fluorine-containing alcohol and heterocyclic organic compound and to suppress the corrosion even if at least a part of the pump contacting the medium is made of a light metal in order to decrease the weight as described above.

Moreover, by using a Wesco-type pump for the pumps P1, P2, and P3 used for the absorption-type cooling unit constituting a low-pressure closed circuit, it is possible to minimize cavitation which is easily caused in the pumps P1 to P3 because of the low pressure and moreover, the rotor 26 is made of resol-type phenol resin in the Wesco-type pumps P1 to P3. The resol-type phenol resin is an ammonia-free phenol resin on a base of glass fibers, which has a small dimensional change and a small strength change caused by the solution and is superior in solution resistant stability. Therefore, it is possible to obtain a superior durability while decreasing the weights of the rotor 26 and housing 25, that is, the pumps P1 to P3 in weight. Moreover, even if cavitation occurs, it is possible to provide impact resistance for the rotor 26 by absorbing the impact when bubbles collapse due to cavitation by the flexibility of the synthetic resin because the rotor 26 is made of the synthetic resin.

The above resol-type phenol resin is able to keep the degree of swelling due to moisture contained in the medium in a relatively large quantity at a very low level in order to improve the corrosion resistance of a light metal as shown in FIG. 6. Therefore, it is possible to obtain a desired pump performance by minimizing the dimensional change rate of the rotor 26 which greatly changes the gap between the housing 25 and the rotor 26 due to swelling.

In the case of a Wesco-type pump, the dimension $\delta$ of the gap 42 formed between the outer periphery of the rotor 26 and the partition 35 is set by considering the machining allowance, thermal expansion, and swelling of the rotor 26. In this case, an allowable value of the dimensional change rate due to swelling is 0.15% as described in relation with FIG. 5 and the maximum value of the moisture content rate of the medium to meet the allowable value 0.15% is set to 10 wt % as described in relation with FIG. 6. Therefore, it is possible to add enough water to suppress the corrosion of a light metal due to the medium to the solution and moreover, keep the dimension of the gap between the rotor 26 and the housing 25 that changes due to swelling of the rotor 26 within an allowable value, and obtain a desired pump performance.

The preferred embodiment of the present invention is described above. However, the present invention is not restricted to the embodiment. It is possible to design various modifications as long as they are not deviated from the present invention defined in claims.

What is claimed is:

1. A pump comprising a rotor made of a synthetic resin and rotating in a fixed housing which rotor and housing are adjacently arranged while forming a gap between the housing the rotor to raise the pressure of a medium obtained by adding water to a solution being pumped by the pump, wherein the rotor is made of resol-type phenol resin so that a dimensional change rate by swelling of the rotor is 0.15% or less for a medium having a water moisture content rate of 10 wt % or less, said swelling being due to the effects of the presence of water in the medium, and at least a portion of the pump containing the medium other than the rotor is made of a light metal subject to being corroded by the solution.

2. The pump according to claim 1, wherein the resol-type phenol resin is resol-type high-heat phenol resin equivalent to PM-HH-R in JIS-K-6915.

3. The pump according to claim 1, wherein the resol-type phenol resin is resol-type heat-resistant and impact phenol resin equivalent to PM-HM-R in JIS-K-6915.

4. The pump according to claim 1, wherein the solution which is a part of the medium is made of fluorine-containing alcohol and heterocyclic organic compound.

5. The pump according to claim 1, wherein the pump is a Wesco-type pump.

6. A pump for a medium having a corrosive solution to which water is added for reducing the corrosive characteristic of the medium, comprising a fixed housing and a rotor rotatably mounted in the housing, a clearance gap between the housing and the rotor to be maintained at a minimum for pump efficiency, wherein the rotor is made of resol-type phenol resin having a water moisture resistance property such that a dimensional change rate by swelling of the rotor is 0.15% or less for the medium having a moisture content rate of greater than 2% and not more than 10% said swelling being due to the effects of the presence of water in the medium, and at least a portion of the pump contacting the medium other than the rotor is made of a light metal subject to being corroded by the solution.

7. The pump according to claim 6, wherein the resol-type phenol resin is resol-type high-heat phenol resin equivalent to PM-HH-R in JIS-K-6915.

8. The pump according to claim 6, wherein the resol-type phenol resin is resol-type heat resistant and impact phenol resin equivalent to PM-HM-R in JIS-K-6915, and wherein the moisture content rate of the medium is less than 12%.

9. The pump according to any one of claims 6, 7 or 8, wherein the moisture content rate of the medium is between about 5% and 10%.

10. A medium circulation apparatus comprising a pump in a closed circuit for circulating a medium obtained by adding water to a solution having a characteristic of corroding a light metal and wherein at least a portion of the components constituting the closed circuit and contacting the medium is made of a light metal, said pump having a fixed housing and a rotor rotatably mounted in said housing, said housing and rotor positioned to form a gap between said housing and said rotor to raise the pressure of the medium, wherein said rotor is made of resol-type phenol resin so that a dimensional change rate by swelling of said rotor is 0.15% or less for a medium having a water moisture content rate of 10 wt % or less, said swelling being due to the effects of the presence of water in the medium, and at least a portion of the pump contacting the medium other than the rotor is made of a light metal subject to being corroded by the solution.

11. The medium circulation apparatus according to claim 10, wherein the resol-type phenol resin is resol-type high-heat phenol resin equivalent to PM-HH-R in JIS-K 6915.

12. The medium circulation apparatus according to claim 10, wherein the resol-type resin is resol-type heat-resistant and impact phenol resin equivalent to PM-HM-R in JIS-K-6915.

13. The medium circulation apparatus according to claim 10, wherein the apparatus comprises a low-pressure closed circuit.

14. The medium circulation apparatus according to claim 13, wherein the apparatus is an absorption-type cooling unit.

15. The medium circulation apparatus according to claim 14, wherein the solution which is a part of the medium is made of fluorine-containing alcohol and heterocyclic organic compound.

16. The medium circulation apparatus according to claim 13, wherein said pump is a Wesco-type pump.

17. The pump according to claim 1, wherein said dimensional change rate of the rotor based on said swelling of said rotor is determined by using a lower limit of a pump efficiency of said pump and an upper limit of a total dimensional change rate of the rotor determined by taking account of machining allowance, thermal expansion and said swelling of the rotor.

18. The pump according to claim 6, wherein said dimensional change rate of the rotor based on said swelling of said rotor is determined by using a lower limit of a pump efficiency of said pump and an upper limit of a total dimensional change rate of the rotor determined by taking account of machining allowance, thermal expansion and said swelling of the rotor.

19. The pump according to claim 10, wherein said dimensional change rate of the rotor based on said swelling of said rotor is determined by using a lower limit of a pump efficiency of said pump and an upper limit of a total dimensional change rate of the rotor determined by taking account of machining allowance, thermal expansion and said swelling of the rotor.

* * * * *